US007445032B2

(12) United States Patent
Barrett et al.

(10) Patent No.: US 7,445,032 B2
(45) Date of Patent: Nov. 4, 2008

(54) BULK ENHANCING FORMING FABRICS

(75) Inventors: Rex Barrett, Neenah, WI (US); Rae Patel, Appleton, WI (US)

(73) Assignee: AstenJohnson, Inc., Charleston, SC (US)

( * ) Notice: Subject to any disclaimer, the term of this patent is extended or adjusted under 35 U.S.C. 154(b) by 167 days.

(21) Appl. No.: 11/418,564

(22) Filed: May 5, 2006

(65) Prior Publication Data

US 2006/0249220 A1 Nov. 9, 2006

Related U.S. Application Data

(60) Provisional application No. 60/677,893, filed on May 5, 2005.

(51) Int. Cl.
*D21F 7/08* (2006.01)
*D21F 7/10* (2006.01)
*D03D 25/00* (2006.01)

(52) U.S. Cl. ..... 139/383 A; 139/383 AA; 162/348; 162/358.2

(58) Field of Classification Search ..... 139/383 A, 139/383 AA; 162/358.2, 348, 900, 903
See application file for complete search history.

(56) References Cited

U.S. PATENT DOCUMENTS 3,851,681 A 12/1974 Egan
4,408,638 A 10/1983 Strom
5,074,339 A 12/1991 Vohringer
5,181,117 A 1/1993 Choi et al.
5,211,815 A 5/1993 Ramasubramanian et al.
5,456,293 A 10/1995 Ostermayer et al.
5,542,455 A 8/1996 Ostermayer et al.
5,817,213 A 10/1998 Ostermayer et al.
5,826,627 A 10/1998 Seabrook et al.
5,839,479 A 11/1998 Gulya et al.
5,853,547 A 12/1998 Ahrens et al.
5,988,229 A * 11/1999 Quigley ..... 139/383 A
6,000,440 A * 12/1999 Hay ..... 139/383 A
6,237,644 B1 * 5/2001 Hay et al. ..... 139/383 A
6,592,714 B2 * 7/2003 Lamb ..... 162/116
6,649,026 B2 11/2003 Lamb
6,708,732 B1 3/2004 Hay et al.
6,780,800 B2 * 8/2004 Itoh ..... 442/190
6,821,391 B2 11/2004 Scherb et al.
6,841,037 B2 1/2005 Scherb et al.
6,896,009 B2 5/2005 Ward
7,059,357 B2 * 6/2006 Ward ..... 139/348

(Continued)

FOREIGN PATENT DOCUMENTS

WO 2005/035867 4/2005

*Primary Examiner*—Bobby H Muromoto, Jr.
(74) *Attorney, Agent, or Firm*—Volpe and Koenig, P.C.

(57) ABSTRACT

A multilayered papermakers' forming fabric comprises at least one set of machine direction (MD) warp yarns, at least a first set of cross-machine direction (CD) machine side layer weft yarns; and paper side layer weft yarns woven in a repeating pattern with at least some of the MD warp yarns. At least some of the paper side layer weft yarns comprise an array of bulk enhancing weft yarns each having a vertical dimension which exceeds a corresponding vertical dimension of each of the remaining paper side layer weft yarns in a ratio of at least 1.25:1. Selected weft yarns can have different float lengths in the paper side surface. The fabrics of the invention impart increased bulk for products such as towel or tissue without loss of other required characteristics.

20 Claims, 10 Drawing Sheets

U.S. PATENT DOCUMENTS

| | | | | |
|---|---|---|---|---|
| 7,059,360 | B1 * | 6/2006 | Majaury et al. | 139/383 A |
| 7,108,020 | B2 * | 9/2006 | Stone | 139/383 A |
| 7,195,040 | B2 * | 3/2007 | Ward | 139/383 A |
| 7,216,677 | B2 * | 5/2007 | Fujisawa | 139/383 A |
| 7,219,701 | B2 * | 5/2007 | Ward | 139/383 A |
| 7,243,687 | B2 * | 7/2007 | Barratte | 139/383 A |
| 2002/0088596 | A1 * | 7/2002 | Lamb | 162/902 |
| 2004/0182465 | A1 * | 9/2004 | Ward | 139/383 A |
| 2005/0067039 | A1 * | 3/2005 | LaFond et al. | 139/383 A |
| 2005/0103397 | A1 * | 5/2005 | Quigley et al. | 139/383 A |
| 2006/0162803 | A1 * | 7/2006 | Vines | 139/383 A |
| 2006/0162804 | A1 * | 7/2006 | Heger et al. | 139/383 A |
| 2006/0249220 | A1 * | 11/2006 | Barrett et al. | 139/383 A |
| 2006/0278294 | A1 * | 12/2006 | Quigley | 139/383 A |
| 2006/0278296 | A1 * | 12/2006 | Ito | 139/383 A |
| 2007/0068590 | A1 * | 3/2007 | Quigley | 139/383 A |
| 2007/0095416 | A1 * | 5/2007 | Ueda | 139/383 A |
| 2007/0095417 | A1 * | 5/2007 | Fujisawa | 139/383 A |

* cited by examiner

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 2 | 1 | | | 4 | | | 7 | 8 | 9 | 10 | 11 | 12 | | | | | | | | | | 22 | | |
| 3 | 1 | 2 | 3 | 4 | 5 | 6 | 7 | | | 10 | | | | | | 16 | | | | | | | | |
| 4 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 5 | | 2 | | | 5 | | | 8 | | | 11 | | | | | | | | | | | | | |
| 6 | | | 3 | | | 6 | | | 9 | | | 12 | | | | | | | | | | | | |
| 7 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 8 | 1 | | | 4 | 5 | 6 | 7 | 8 | 9 | 10 | | | | | | | | | 19 | | | | | |
| 9 | 1 | 2 | 3 | 4 | | | 7 | | | 10 | 11 | 12 | 13 | | | | | | | | | | | |
| 10 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 11 | | 2 | | | 5 | | | 8 | | | 11 | | | | | | | | | | | | | |
| 12 | | | 3 | | | 6 | | | 9 | | | 12 | | | | | | | | | | | | |
| 13 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 14 | 1 | 2 | 3 | 4 | | | 7 | | | 10 | 11 | 12 | | | | | | | | | | | | 24 |
| 15 | 1 | | | 4 | 5 | 6 | 7 | 8 | 9 | 10 | | | | | | | | 18 | | | | | | |
| 16 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 17 | | 2 | | | 5 | | | 8 | | | 11 | | | | | | | | | | | | | |
| 18 | | | 3 | | | 6 | | | 9 | | | 12 | | | | | | | | | | | | |
| 19 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 20 | 1 | | | 4 | | | 7 | 8 | 9 | 10 | 11 | 12 | | | | | | | | | 21 | | | |
| 21 | 1 | 2 | 3 | 4 | 5 | 6 | 7 | | | 10 | | | | | 15 | | | | | | | | | |
| 22 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 23 | | 2 | | | 5 | | | 8 | | | 11 | | | | | | | | | | | | | |
| 24 | | | 3 | | | 6 | | | 9 | | | 12 | | | | | | | | | | | | |
| 25 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 26 | 1 | | | 4 | 5 | 6 | 7 | 8 | 9 | 10 | | | | | | | | | | 20 | | | | |
| 27 | 1 | 2 | 3 | 4 | | | 7 | | | 10 | 11 | 12 | | 14 | | | | | | | | | | |
| 28 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 29 | | 2 | | | 5 | | | 8 | | | 11 | | | | | | | | | | | | | |
| 30 | | | 3 | | | 6 | | | 9 | | | 12 | | | | | | | | | | | | |
| 31 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 32 | 1 | | | 4 | | | 7 | 8 | 9 | 10 | 11 | 12 | | | | | | | | | | | 23 | |
| 33 | 1 | 2 | 3 | 4 | 5 | 6 | 7 | | | 10 | | | | | | | 17 | | | | | | | |
| 34 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 35 | | 2 | | | 5 | | | 8 | | | 11 | | | | | | | | | | | | | |
| 36 | | | 3 | | | 6 | | | 9 | | | 12 | | | | | | | | | | | | |

FIG. 6

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 2 | 1 | | | 4 | | | 7 | 8 | 9 | 10 | 11 | 12 | | | | | | | | | | 22 | | |
| 3 | 1 | 2 | 3 | 4 | 5 | 6 | 7 | | | 10 | | | | | | 16 | | | | | | | | |
| 4 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 5 | | 2 | | | 5 | | | 8 | | | 11 | | | | | | | | | | | | | |
| 6 | | | 3 | | | 6 | | | 9 | | | 12 | | | | | | | | | | | | |
| 7 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 8 | 1 | | | 4 | 5 | 6 | 7 | 8 | 9 | 10 | | | | | | | | | 19 | | | | | |
| 9 | 1 | 2 | 3 | 4 | | | 7 | | | 10 | 11 | 12 | 13 | | | | | | | | | | | |
| 10 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 11 | | 2 | | | 5 | | | 8 | | | 11 | | | | | | | | | | | | | |
| 12 | | | 3 | | | 6 | | | 9 | | | 12 | | | | | | | | | | | | |
| 13 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 14 | 1 | 2 | 3 | 4 | | | 7 | | | 10 | 11 | 12 | | | | | | | | | | | | 24 |
| 15 | 1 | | | 4 | 5 | 6 | 7 | 8 | 9 | 10 | | | | | | | | 18 | | | | | | |
| 16 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 17 | | 2 | | | 5 | | | 8 | | | 11 | | | | | | | | | | | | | |
| 18 | | | 3 | | | 6 | | | 9 | | | 12 | | | | | | | | | | | | |
| 19 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 20 | 1 | | | 4 | | | 7 | 8 | 9 | 10 | 11 | 12 | | | | | | | | | 21 | | | |
| 21 | 1 | 2 | 3 | 4 | 5 | 6 | 7 | | | 10 | | | | | 15 | | | | | | | | | |
| 22 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 23 | | 2 | | | 5 | | | 8 | | | 11 | | | | | | | | | | | | | |
| 24 | | | 3 | | | 6 | | | 9 | | | 12 | | | | | | | | | | | | |
| 25 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 26 | 1 | | | 4 | 5 | 6 | 7 | 8 | 9 | 10 | | | | | | | | | | 20 | | | | |
| 27 | 1 | 2 | 3 | 4 | | | 7 | | | 10 | 11 | 12 | | 14 | | | | | | | | | | |
| 28 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 29 | | 2 | | | 5 | | | 8 | | | 11 | | | | | | | | | | | | | |
| 30 | | | 3 | | | 6 | | | 9 | | | 12 | | | | | | | | | | | | |
| 31 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 32 | 1 | | | 4 | | | 7 | 8 | 9 | 10 | 11 | 12 | | | | | | | | | | | 23 | |
| 33 | 1 | 2 | 3 | 4 | 5 | 6 | 7 | | | 10 | | | | | | | 17 | | | | | | | |
| 34 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 35 | | 2 | | | 5 | | | 8 | | | 11 | | | | | | | | | | | | | |
| 36 | | | 3 | | | 6 | | | 9 | | | 12 | | | | | | | | | | | | |

FIG. 7

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 2 | 1 | | | 4 | | | 7 | 8 | 9 | 10 | 11 | 12 | | | | | | | | | | 22 | | |
| 3 | 1 | 2 | 3 | 4 | 5 | 6 | 7 | | | 10 | | | | | | 16 | | | | | | | | |
| 4 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 5 | | 2 | | | 5 | | | 8 | | | 11 | | | | | | | | | | | | | |
| 6 | | | 3 | | | 6 | | | 9 | | | 12 | | | | | | | | | | | | |
| 7 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 8 | **1** | **2** | **3** | **4** | | | | | | **10** | **11** | **12** | **13** | | | | | | | | | | | |
| 9 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 10 | | 2 | | | 5 | | | 8 | | | 11 | | | | | | | | | | | | | |
| 11 | | | 3 | | | 6 | | | 9 | | | 12 | | | | | | | | | | | | |
| 12 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 13 | 1 | 2 | 3 | 4 | | | | | | 10 | 11 | 12 | | | | | | | | | | | | 24 |
| 14 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 15 | | 2 | | | 5 | | | 8 | | | 11 | | | | | | | | | | | | | |
| 16 | | | 3 | | | 6 | | | 9 | | | 12 | | | | | | | | | | | | |
| 17 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 18 | 1 | | | 4 | | | 7 | 8 | 9 | 10 | 11 | 12 | | | | | | | | | 21 | | | |
| 19 | 1 | 2 | 3 | 4 | 5 | 6 | 7 | | | 10 | | | | | 15 | | | | | | | | | |
| 20 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 21 | | 2 | | | 5 | | | 8 | | | 11 | | | | | | | | | | | | | |
| 22 | | | 3 | | | 6 | | | 9 | | | 12 | | | | | | | | | | | | |
| 23 | 1 | 2 | 3 | 4 | 5 | 6 | 7 | 8 | 9 | 10 | 11 | 12 | 13 | 14 | | 16 | 17 | 18 | | 20 | 21 | 22 | | 24 |
| 24 | 1 | 2 | 3 | 4 | | | | | | 10 | 11 | 12 | | 14 | | | | | | | | | | |
| 25 | 1 | 2 | 3 | 4 | 5 | 6 | 7 | 8 | 9 | 10 | 11 | 12 | | 14 | 15 | 16 | | 18 | 19 | 20 | | 22 | 23 | 24 |
| 26 | | 2 | | | 5 | | | 8 | | | 11 | | | | | | | | | | | | | |
| 27 | | | 3 | | | 6 | | | 9 | | | 12 | | | | | | | | | | | | |
| 28 | 1 | 2 | 3 | 4 | 5 | 6 | 7 | 8 | 9 | 10 | 11 | 12 | 13 | | 15 | 16 | 17 | | 19 | 20 | 21 | | 23 | 24 |
| 29 | 1 | | | | | | 7 | 8 | 9 | 10 | 11 | 12 | | | | | | | | | | | 23 | |
| 30 | 1 | 2 | 3 | 4 | 5 | 6 | 7 | 8 | 9 | 10 | 11 | 12 | 13 | 14 | 15 | | 17 | 18 | 19 | | 21 | 22 | 23 | |
| 31 | | 2 | | | 5 | | | 8 | | | 11 | | | | | | | | | | | | | |
| 32 | | | 3 | | | 6 | | | 9 | | | 12 | | | | | | | | | | | | |

FIG. 8

BULK ENHANCING FORMING FABRICS

CROSS-REFERENCE TO RELATED APPLICATIONS

The present application claims the benefit of U.S. Provisional Application No. 60/677,893, filed May 5, 2005, which is incorporated by reference herein as if fully set forth.

BACKGROUND

The present invention relates generally to multilayer papermakers' forming fabrics which can impart bulk to paper sheets formed thereon. It is particularly concerned with such forming fabrics which impart bulk due to the use of one or more weft yarns in the chosen paper side layer weave pattern which have a vertical dimension, measured in a direction substantially perpendicular to the paper side surface of the paper side layer, which is at least 1.25 times that of the corresponding vertical dimension of the remainder of the paper side layer weft yarns.

In the manufacture of paper products where a smooth sheet is required, such as for newsprint and other printing applications, the weave patterns selected for use in the paper side layer of the forming fabric upon which the sheet is formed are generally designed to maximize the planarity of the fabric and support the papermaking fibers evenly. For example, the objective of the composite forming fabrics disclosed in Seabrook et al. in U.S. Pat. No. 5,826,627 is to provide a generally planar surface upon which the paper sheet can be formed with minimal irregularities.

The forming fabrics disclosed by Seabrook et al. consist of a machine side (MS) layer of interlaced warp and weft yarns, and a separate paper side (PS) layer of interwoven warp and weft yarns. The PS weft consist of two sets of yarns: the first set, sometimes referred to as the primary weft, are weft yarns which interweave solely with the PS layer warp to form a portion of the papermaking surface. The second set, referred to as the "intrinsic weft binder yarns", are pairs of yarns which, in each repeat of the fabric weave pattern interweave sequentially with the PS warp yarns to occupy an unbroken weft path in the PS, and interlace with at least one warp in the MS surface so as to bind the PS and MS layers of the fabric together. Each part of the unbroken weft path is separated from the adjacent parts of the unbroken weft path by at least one PS warp yarn. The weave pattern of the unbroken weft path may be the same as, or different from, that of the immediately adjacent primary weft yarns.

In those fabrics, the primary weft yarns of the first set are generally all circular in cross-section and have the same first diameter, and the intrinsic weft binder yarn pair members of the second set are all of the same second diameter, and this second diameter is generally less than or equal to the first diameter. The relative differences in diameter are limited by the need to avoid irregularities which would cause undesirable marking of the incipient paper web. Thus, the first and second yarn diameters should generally be relatively similar one to the other. For example, if the primary PS weft is about 0.13 mm in diameter, the intrinsic weft binder yarns will be from about 0.11 mm to about 0.13 mm in diameter.

Weave patterns for forming fabrics are also known in which variations of yarn sizes are used for different intended purposes. For example, U.S. Pat. No. 3,851,681 to Egan, and U.S. Pat. No. 5,181,117 to Huhtiniemi disclose forming fabrics using yarns of alternating diameter to provide improved wear resistance on the machine side surface. U.S. Pat. No. 5,074,339 to Vohringer discloses a double layer forming fabric woven in a 6-shed pattern with alternating large and small diameter weft yarns in the PS, grouped together in pairs to form a reverse funnel effect for improved drainage and sheet formation.

In the manufacture of cellulosic products such as towel and tissue, it is desirable to impart a measure of bulk to the sheet, most preferably with localized areas of bulk or non-uniformity. Various methods are known by which bulk can be imparted to localized areas by patterning of the forming fabrics. These methods include (1) adjusting the fabric weave pattern to create areas of high and low fabric yarn density and/or elevation, (2) applying a plastic resinous material onto the surface of the fabric in a predetermined pattern and (3) applying shaped plastic items to the surface of the fabric to impart or mold a desired shape into the sheet, and so on.

U.S. Pat. No. 6,841,037 (Scherb et al), U.S. Pat. No. 6,821,391 (Hay et al.) and U.S. Pat. No. 6,708,732 (Hay et al.) all generally disclose methods of forming paper products such as towel and tissue using fabrics which have systematically distributed areas of high drainage. However, a disadvantage of these fabrics is that the areas of high drainage have a relatively more open mesh which will tend to trap a portion of the papermaking fibers in the fabric, making it necessary to provide a cleaning mechanism so as to remove these fibers and prevent localized plugging of the fabric (see e.g. U.S. Pat. No. 6,841,037 at Col. 7, lines 28-56; U.S. Pat. No. 6,821,391, at Col. 3, lines 6-25). It will be appreciated that fabrics which are woven according to the teachings of any of Scherb et al. or Hay et al. must of necessity have distributed areas of high and low air permeability due to the nature of the disclosed yarn arrangements. Further, the warp yarn arrangement in fabrics constructed according to the teachings of Hay et al. must form " . . . relatively long machine side floats" in the machine direction of the fabric (see U.S. Pat. No. 6,708,732 at Col. 4, lines 32-43). In addition, a portion of the weft yarns in fabrics woven according to the teachings of U.S. Pat. No. 6,708,732 are arranged so as to form an acute angle with the machine direction of the fabric.

It should also be noted that U.S. Pat. No. 6,841,037 claims a machine for producing a tissue web by means of a forming fabric having at least two zones of different wire permeabilities formed by "weaving threads of at least one different diameter and different weaving patterns". However, this patent is entirely silent on the types of weaving patterns which could be used, or the different yarn diameters which would be suitable, and does not teach any manner of selecting either suitable weave patterns or yarn sizes. Further, U.S. Pat. No. 6,841,037 teaches the use of differing weave patterns within the fabric so as to obtain the zones of differing air permeability which will be about 5 mm or less in size, and thus does not disclose a forming fabric having a generally uniform air permeability.

WO 2005/035867 to Lafond et al. discloses a multilayer papermaking fabric having topographical differences created by a plane difference between at least two top weft yarns due to a different diameter, size, or shape. However, the disclosure lacks any specifics with respect to weave constructions and yarn sizes, and in particular is entirely silent as to suitable or preferred yarn sizes or weave patterns, and there is no indication of what the absolute difference in size, or feasible ranges, of the larger yarns might be as compared with the smaller weft yarns. Further, there is no disclosure of a preferred PS and MS weave combination that may provide beneficial results, nor is there teaching of what is meant by "hard" and "soft" materials in terms of the combinations of materials recited. Still further, there is no indication that any fabric disclosed has been successfully made or tested, or that it could be successfully produced without further experimentation.

U.S. Pat. No. 6,896,009 to Ward discloses a triple layer forming fabric which uses machine direction (MD) binder yarn pairs, in weave patterns which can include a variation in the diameter of the PS cross-machine direction (CD) yarns. However, the purpose of such variation, and for which a variation in yarn modulus can be substituted, is stated as being to compensate for the reduction in crimp of the MD yarns which otherwise may occur at the exchange points where one member of the pair enters the PS surface and the second member of the pair leaves the PS surface. Thus, the diameter variations contemplated are in the transverse direction to the binder yarn pairs. The patent does not teach the use of yarn diameter variations for yarns in the same direction as binder yarn pairs; and does not teach the use of such variations to provide a bulk enhancement for the paper sheet. To the contrary, the patent suggests that the use of the diameter variations as taught may improve sheet uniformity, by avoiding the steep "diving angle" of the yarns which are exchanging positions, i.e. by providing a smoother fabric surface.

U.S. Pat. No. 5,456,293; U.S. Pat. No. 5,542,455 and U.S. Pat. No. 5,817,213, each to Ostermayer et al., show the use of alternating diameter weft yarns in single layer forming fabrics to create bulk in tissue sheets. However, each these references relates only to single layer fabrics, and does not disclose or suggest any manner of using different weft yarn sizes in multilayered forming fabrics, such as double layer or composite fabrics.

For certain grades of tissue, it is preferred to form the sheet (which has a very low basis weight, in the range of about 5 grams per square meter, or gsm) on a patterned forming fabric as this provides areas of both high and low fiber density and correspondingly of high and low basis weight. Areas of the fabric which are raised relative to the fabric plane will produce a "bump" of low basis weight tissue, while depressions may create a "dimple" of a higher basis weight.

However, formation of such patterned areas by applying and securely attaching either a second material onto selected areas on the surface of a woven substrate, or by interlacing additional yarns according to a desired pattern, is a time-consuming and costly endeavour requiring a high degree of skill and complex machinery.

Thus, it would be desirable if a more cost effective and simple means were provided to impart bulk into the tissue sheet being formed on a multilayered forming fabric.

We have now discovered that it is possible to impart a measure of bulk into cellulosic products such as towel and tissue by forming them on fabrics having weave patterns which are similar or closely related to the forming fabrics disclosed by Seabrook et al. U.S. Pat. No. 5,826,627 being comprised of at least two layers of weft yarns, but in which the paper side layer weft yarns include both bulk enhancing (henceforth referred to as "BE yarns") which have a relatively greater vertical dimension than the vertical dimension of the remainder of the weft yarns in the paper side surface.

As used herein, and as discussed further below, the term "vertical dimension" refers to the measurement of a yarn in the direction which will be substantially perpendicular to the paper side surface of the fabric when woven.

Surprisingly, we have found that fabrics woven according to weave patterns similar to those described in Seabrook et al., in U.S. Pat. No. 5,826,627, which have previously been intended to provide a very smooth and uniform sheet, may be used to generate high bulk in paper webs such as are intended for tissue or towel, by incorporating at least one BE yarn in each repeat of the paper side layer weave pattern. Weave patterns similar to those described in Seabrook et al., and noted above, include designs wherein the PS layer is comprised of two sets of weft yarns, one of which interweaves with the PS warp yarns only, and the other of which also contributes to the PS layer weave pattern and also interlaces with the MS warp yarns so as to bind the two layers together. FIG. 4 of the Seabrook et al. patent illustrates a typical weave pattern and yarn arrangement for fabrics of this type; other arrangements are possible within the scope of this invention.

According to the present invention, it has been found that bulk enhancement of the paper web formed on fabrics of the aforementioned type may be achieved by periodically inserting at least one BE yarn into the fabric weave pattern repeat in one or more of the PS weft positions, such as one or more of the primary weft positions, or in either or both of the intrinsic binder weft positions, in composite forming fabrics generally constructed according to the yarn arrangement described in the Seabrook et al. patent. The insertion may be regular or irregular in occurrence depending on the desired characteristics of the finished product.

Further, we have also found that it is possible to insert these BE yarns into any fabric construction having two layers of weft yarns, without jeopardizing the stability required for the MS layer of the fabric, or any other required fabric properties, provided that the vertical dimension of the BE yarns in the PS layer is compatible with that of the weft yarns used to form the MS layer weave structure. By "compatible" it is meant that the vertical dimension of the BE yarn does not introduce any areas of non-uniformity into the fabric structure such as would render it unstable, generally non-planar or otherwise unsuitable for use in the intended application due to irregularities in its construction induced by use of oversized yarns in the fabric.

Generally, we have found that in fabrics constructed according to the teachings of the present invention, from about 10% to about as much as 50% of the PS weft yarns may be BE yarns, and these may be woven according to any suitable pattern in which they will form floats over at least one, and preferably between two and eleven, warp yarns in the PS layer before interlacing with another warp.

We have also found that further improvement in bulk enhancement can be achieved by the selection of weave patterns for the fabrics of the invention so as to provide for variations in the float lengths of the different groups of weft yarns in the paper side surface of the fabrics. Thus, it is advantageous for at least one group of weft yarns to have longer paper side floats than the floats of the other weft yarns. This group having the longer floats can comprise all or some of one or all the sets of the BE weft yarns, or all or some of one or all the sets of the regular weft yarns.

Optionally, there may be more than one set of these BE yarns utilized in the construction of the PS surface of a fabric according to this invention. In other words, in the fabrics of this invention, it is possible to provide an array of BE yarns having a first set whose vertical dimension is e.g. 3 times the vertical dimension of the regular weft yarns, and a second set of intermediate BE yarns whose vertical dimension is about e.g. 1.5 times that of the regular weft yarns. As used herein, the phrase "regular weft" refers to those weft yarns which have dimensions in the range which would normally be used in the selected weave pattern for the PS surface of the fabric, have a smaller vertical dimension in the woven fabric than the BE yarns, and which have not been inserted into the fabric weave pattern so as to increase sheet bulk.

In a first broad embodiment of the invention, a double layer forming fabric is provided having two separate layers of weft yarns, located on each of the PS and MS layers of the fabric, wherein in the paper side layer the weft yarns comprise regular weft yarns and an array of BE yarns, which comprise between 10% to about 50% by number of the PS weft yarns, and each having a vertical dimension, measured in a direction substantially perpendicular to the PS surface of the woven fabric, from about 1.25 to about 3.0 times that of the regular PS weft yarns. The fabric may be of any weave construction as would be appropriate for the intended end use, but the PS weave pattern of the fabric is selected such that the float length of the BE yarns is at least one, and preferably between two and eleven, warp yarns.

Optionally, the array of BE weft yarns can comprise two sets, the first having the largest vertical dimension, and the second set having a vertical dimension which is less than that of the first set, yet nevertheless exceed that of the regular PS weft yarns by at least 1.25:1.

In a second more specific embodiment of this invention, the bulk enhancing forming fabric is a composite structure woven according to the general construction shown in U.S. Pat. No. 5,826,627 to Seabrook et al. In one version of this embodiment, the repeating weave pattern for the PS layer provides for the location in the PS of the BE weft yarns to vary between the positions of a or each primary weft, the first intrinsic weft pair member and the second intrinsic weft yarn pair member, in each successive repeat of the PS weave pattern. In this embodiment, from about 10% to about 50% of the paper side surface weft yarns are BE yarns whose vertical dimension is from about 1.25 to about 3.0 times that of at least one immediately adjacent weft yarn in the paper side surface of the fabric. Further, the PS weave pattern of the fabric is selected such that the float length of the BE yarns is at least one, preferably between two and eleven, warp yarns.

In further versions of the second embodiment, the repeating weave pattern for the PS layer provides for the BE yarns to be located in a single position, i.e. they are always primary weft yarns, or always the same ones of pairs of intrinsic weft binder yarns. In each of these versions of the second embodiment, the BE yarns have a vertical dimension that is from about 1.25 to about 3.0 times that of the other regular weft yarns and are located in about 10% to 50% of the PS weft yarn positions.

SUMMARY

The invention therefore seeks to provide a multilayered papermakers' forming fabric woven to a first repeating pattern, having a paper side layer with a paper side surface and a machine side layer having a machine side surface, and comprising (i) at least one set of machine direction (MD) warp yarns;

(ii) at least a first set of cross-machine direction (CD) machine side layer weft yarns; and (iii) paper side layer weft yarns woven in a second repeating pattern with at least some of the MD warp yarns wherein at least some of the paper side layer weft yarns comprise an array of bulk enhancing weft yarns each having a vertical dimension measured in a direction substantially perpendicular to the paper side surface of the fabric which exceeds a corresponding vertical dimension of each of the remaining paper side layer weft yarns in a ratio of at least 1.25:1.

In a more specific embodiment, the invention seeks to provide a multilayered papermakers' forming fabric as described above, and wherein the warp yarns comprise at least a first set of paper side layer warp yarns and a second set of machine side layer warp yarns, and the paper side layer weft yarns are woven to a second repeating weave pattern and comprise (a) primary weft yarns which do not contribute to the machine side surface; and (b) pairs of intrinsic weft binder yarns and wherein the array of bulk enhancing weft yarns is selected from at least one of the group comprising primary weft yarns, intrinsic weft binder yarns, and a combination of primary weft yarns and intrinsic weft binder yarns.

In another aspect of the present invention, there is provided a multilayered papermakers' forming fabric wherein the warp yarns comprise only pairs of warp binder yarns interwoven with the paper side layer weft yarns and machine side layer weft yarns, wherein: (a) in the paper side surface, each pair of warp binder yarns occupies a single combined path; (b) the pairs of warp binder yarns are woven in the overall repeating weave pattern such that for each pair:

(A) in a first segment of the single combined path, a first member of the pair of interweaves with selected paper side layer weft yarns at an interweaving location, and a second member of the pair interlaces with at least one machine side layer weft yarn at an interlacing location;

(B) in a second segment of the single combined path, the second member of the pair interweaves with selected paper side layer weft yarns at an interweaving location, and the first member of the pair interlaces with at least one machine side layer weft yarn;

(C) the length of the first and second segments may be equal or unequal;

(D) between each adjacent segment the members exchange positions at an exchange point, and the members are laterally displaced in relation to each other along the single combined path at and between each consecutive exchange point.

In accordance with another aspect of the present invention, there is provided a multilayer papermakers' forming fabric wherein the warp yarns comprise a set of triplet warp yarns which are interwoven with the paper side layer weft yarns and the machine side layer weft yarns in a repeating pattern, wherein (a) each member of each triplet of warp yarns interweaves with the paper side layer weft yarns to occupy in sequence segments of a single combined warp path in the paper side layer;

(b) the sequence of segments repeats as part of the repeating pattern;

(c) each segment in the unbroken warp path is separated from the next segment by at least one paper side layer weft yarn;

(d) each member of each triplet interlaces separately with a single machine side layer weft yarn at least once within the pattern repeat;

(e) within the first repeating pattern the number of machine side layer weft yarns between each interlacing point of successive yarns from each triplet of warp yarns is constant; and (f) within the first repeating pattern the path length of each member of each triplet is the same.

The multilayered fabric can be of any type, but preferably is a composite forming fabric or a double-layered forming fabric.

Where the multilayered fabric comprises primary weft yarns and intrinsic weft binder yarns, the number of primary weft yarns between consecutive pairs of intrinsic weft binder yarns can be regular or irregular, and the bulk enhancing weft yarns can occupy yarn paths allocated to selected ones of the primary weft yarns, and first and second members of the pairs of intrinsic binder weft yarns.

Alternatively, the consecutive members of the array of bulk enhancing weft yarns can occupy in sequence weft paths allocated to each primary weft yarn and each member of a pair of intrinsic binder weft yarns, or can occupy in sequence weft paths allocated to each primary weft yarn and a weft path between selected groups of primary weft yarns.

Where the number of primary weft yarns between each pair of intrinsic binder weft yarns is irregular but is at least one, the array of bulk enhancing weft yarns can be selected only from one of the group comprising primary weft yarns, first members of the pairs of intrinsic binder weft yarns, and second members of the pairs of intrinsic weft binder yarns.

The array of bulk enhancing weft yarns can comprise at least a first and a second, or intermediate, set, wherein the vertical dimension of each weft yarn of the second set is less than the corresponding vertical dimension of each of the weft yarns of the first set.

Where there is one set of bulk enhancing weft yarns, the vertical dimension of the array of bulk enhancing weft yarns exceeds the corresponding vertical dimension of the remaining paper side layer weft yarns in a ratio of at least 1.25:1, preferably at least 2:1. Where the array comprises a first and second set, the vertical dimension of the weft yarns of the second set preferably exceeds that of the regular paper side layer weft yarns in a ratio of at least 1.25:1, and the vertical dimension of the weft yarns of the first set preferably exceeds that of the regular paper side layer weft yarns in a ratio of at least 2:1.

In the fabrics of the invention, the array of bulk enhancing weft yarns preferably comprises between 10% and 50% of the paper side layer weft yarns.

The second repeating weave pattern can be selected from plain weave, twill, broken twill, satin and basket weave, and the machine side layer can be woven to a third repeating weave pattern selected from twill, broken twill, satin and an N×2N pattern in which N quantifies the warp yarns in one repeat of the third repeating weave pattern and 2N quantifies the weft yarns in one repeat of the third repeating weave pattern, and N is an integer greater than 2, and preferably N is 6.

Preferably, at least some of the array of bulk enhancing weft yarns have a float length in the paper side layer of between two and eleven warp yarns.

Preferably, each member of the array of bulk enhancing weft yarns has a cross-sectional configuration selected from circular, square, elliptical and rectangular.

Industry definitions for the various types of multilayered forming fabrics are provided in "Weaves of Papermaking Wires and Forming Fabrics" by Perrault and Danby (PAPTAC [Pulp and Paper Technical Association of Canada] Data Sheet G-18, 2004, pp. 1). This invention is applicable to all types of multilayered forming fabric, for which the following are the corresponding definitions, which are hereby adopted:

"Semi Duplex or Extra Support Single Layer or 1½ Layer—woven using one warp (MD) and two weft (CD) yarn systems which are not directly over each other.

Double layer or Duplex—woven using one warp (MD) yarn system and two layers of weft (CD) yarns usually one directly stacked vertically over the other.

Extra Support Double Layer—Is the name given to a double layer weave when extra weft yarns are woven into the top papermaking surface.

Standard Triple layer—woven using two warp (MD) yarn systems and two weft (CD) yarn systems. The final product is two independent fabric structures (top and bottom) which are stitched together during weaving, in the majority of cases using an extra weft (CD) yarn system.

Triple Layer Sheet Support Binder (SSB) or Intrinsic Weft or Paired Binders—woven using two warps (MD) and two weft (CD) yarn systems, however a selected number of the weft yarns are woven into the fabric as pairs of yarns. When one yarn of the pair is being woven into the top surface, the second yarn of the pair is being woven into the bottom. They then interchange, which results in a continuous line of support for papermaking, while providing an increased frequency of tie to the bottom."

Fabrics of this last group, i.e. triple layer SSB or intrinsic weft or paired binders, are sometimes also referred to as "composite forming fabrics".

BRIEF DESCRIPTION OF THE DRAWINGS

The invention will now be described in detail in relation to the drawings in which

FIG. 6 is a weave diagram of the fabric of FIG. 1;

FIG. 7 is a weave diagram of the fabric of FIG. 4;

FIG. 8 is a weave diagram of a third embodiment of the fabrics of the invention;

DETAILED DESCRIPTION OF THE PREFERRED EMBODIMENTS

Figure 9:
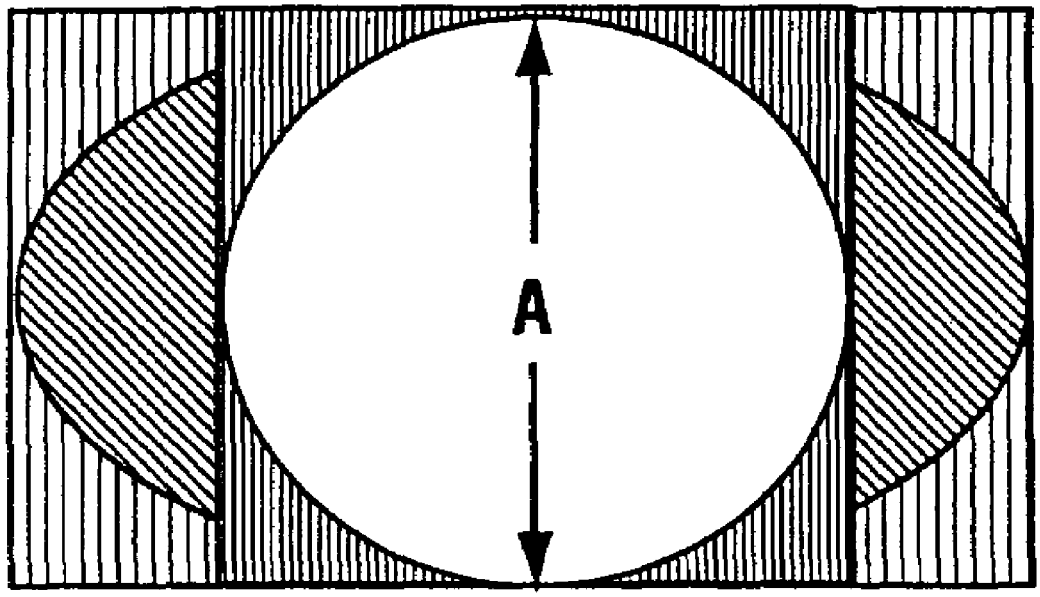
FIG. 9 is a diagram showing the identification of the vertical dimension of yarns for the purpose of the invention.

Referring first to FIG. 9, to facilitate understanding of the features of the invention, some typical yarn configurations are shown in cross-section, being circular, square, elliptical and rectangular. For the purposes of the invention, the significant dimension of the BE yarns is the dimension identified herein as the "vertical dimension", i.e. that which will be substantially perpendicular to the PS surface of the fabric when woven, and which can be compared with the corresponding dimension of the PS layer "regular" (i.e. other than the BE) weft yarns, to identify the degree to which the BE yarns will extend above the surrounding portions of the PS surface as defined by those regular weft yarns. In FIG. 9, the relevant vertical dimension for each of the four selected yarn configurations is indicated by the dimension arrow A.

In the fabrics of the present invention, the BE yarn will have a vertical dimension which is from about 1.25 to at least 3.0 times that of the vertical dimension of the regular weft yarns in the paper side layer of the fabric. The following Table 1 shows the numerical values for the vertical dimensions for different ratios between 1.25 and 3.0 times a regular weft yarn dimension of 0.13 mm (0.0051")

TABLE 1

| Primary Weft Yarn Vertical Dimension "A" | | | BE Yarn Vertical Dimension "A" | |
|---|---|---|---|---|
| Inches | Metric (mm) | Ratio | Inches | Metric (mm) |
| 0.0051 | 0.13 | 1.25:1 | .0064 | 0.162 |
| | | 1.50:1 | .0077 | 0.196 |
| | | 1.75:1 | .0089 | 0.227 |
| | | 2.00:1 | .0100 | 0.259 |
| | | 3.00:1 | .0150 | 0.381 |

The discussion below of the invention in relation to FIGS. 1 to 8 should thus be understood in the context of the measurement of the vertical dimension of the relevant yarns as determined in the manner indicated in FIG. 9.

Figure 1:
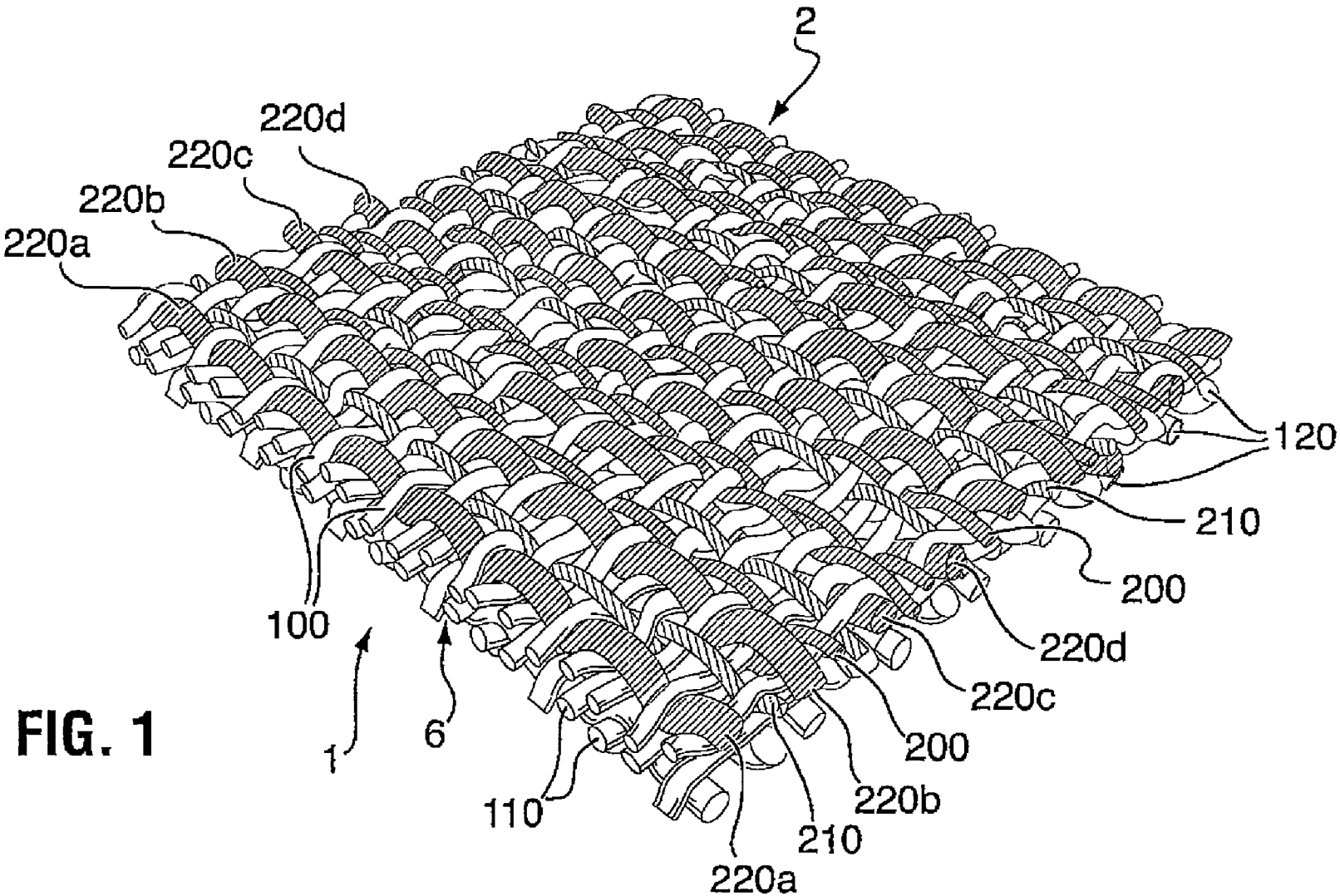
FIG. 1 is a perspective view of a first embodiment of the fabrics of the invention.
Figure 2:
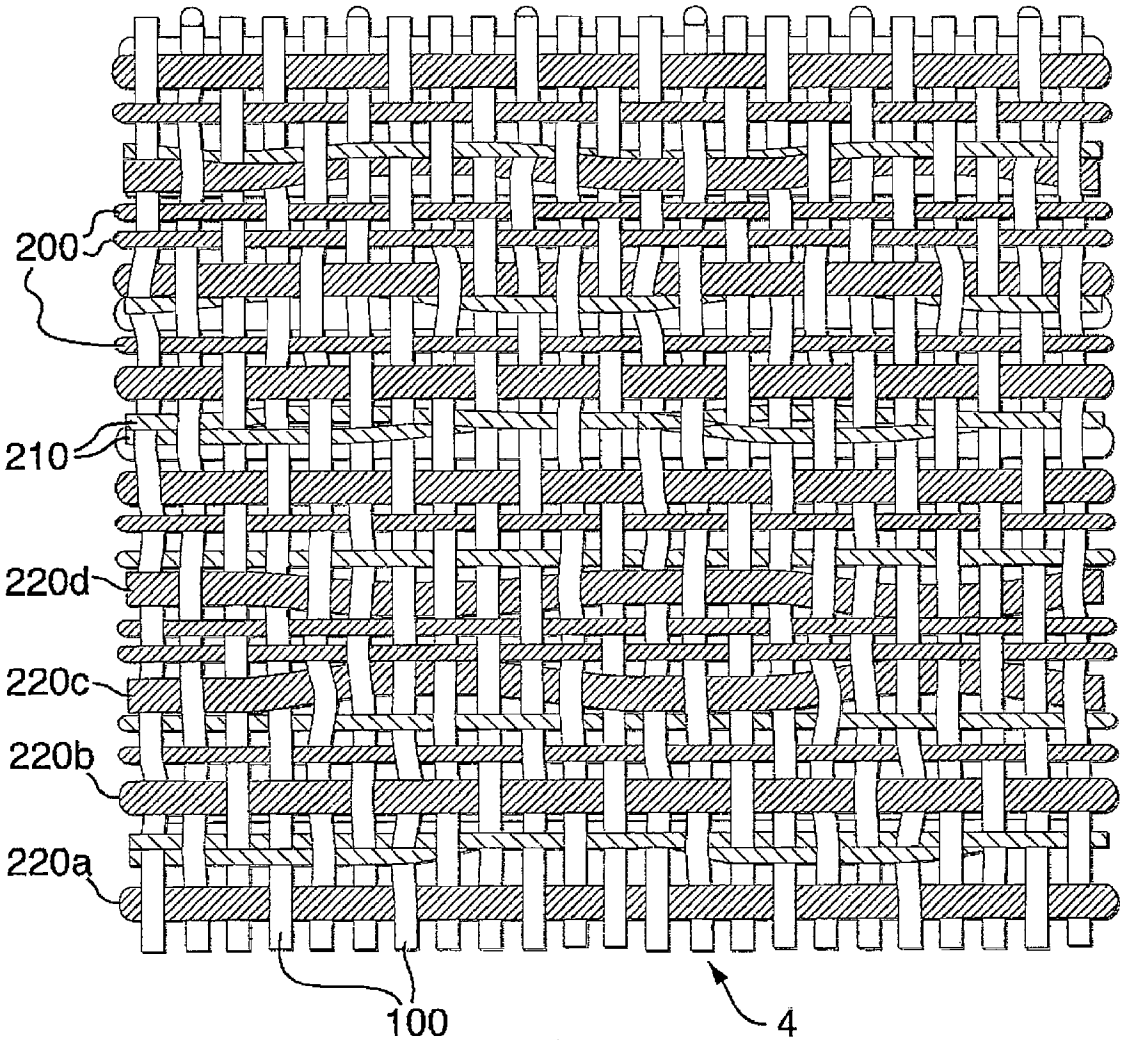
FIG. 2 shows the paper side of the embodiment of FIG. 1.

Referring now to FIGS. 1 and 2, a first embodiment of a fabric of the invention is shown. A fabric 1 has a paper side (PS) layer 2 having a PS surface 4, and a machine side (MS) layer 6 which has an MS surface 8 (shown in FIG. 3). Two sets of warp yarns are provided, PS warps 100 in the PS layer 2, and MS warps 110 in the MS layer 6. In the PS layer 2, primary PS weft yarns 200 interweave with the PS warps 100 and remain in that layer only, whereas pairs of intrinsic binder weft yarns 210 interweave with the PS warps 100 and interlace with the MS warps 110, to bind the PS layer 2 and the MS layer 6 together. Each of the primary PS weft yarns 200 follows a twill pattern, i.e. passing over two, under one warp yarns 100. The pairs of intrinsic binder weft yarns 210 alternate with each other in the PS layer 2 and the MS layer 6, so that each in turn contributes to the weave pattern of the PS surface 4, in this embodiment following the same over two, under one twill pattern of the primary PS weft yarns 200.

A set of bulk enhancing (BE) weft yarns 220 is provided in the PS layer 2. In the repeating weave pattern of this embodiment, there are two primary PS weft yarns 200 between each pair of intrinsic binder weft yarns 210. The BE weft yarns 220 of this pattern are introduced in the location of each of the primary PS weft yarns 200 and intrinsic binder weft yarns 210 in turn, in this case as every third weft yarn, in the sequence of second primary PS weft yarn 200, first primary PS weft yarn 200, second intrinsic binder weft yarn 210, first intrinsic binder weft yarn 210. Thus, commencing at the lower right portion of FIG. 1, and the lower edge of FIG. 2, BE weft yarn 220*a* is in the pattern location for the second of the two primary PS weft yarns 200, BE weft yarn 220*b* is in the pattern location for the first of the two primary PS weft yarns 200 in the next repeat, BE weft yarn 220*c* is in the pattern location for the second of the next succeeding pair of intrinsic binder weft yarns 210, and BE weft yarn 220*d* is in the pattern location for the first of the next succeeding pair of intrinsic binder weft yarns 210.

FIG. 2 is a plan view of the PS surface 4 of the fabric 1, shown in perspective in FIG. 1. From this figure, it can be clearly seen that the BE yarn is introduced into the pattern and interwoven with the warp yarns in a manner such that it cycles through each of the four weft positions of the repeating weave pattern. However, as discussed below, other manners of introducing the BE yarns to the repeating weave patterns are possible.

FIG. 6 is a weave diagram showing the complete repeating weave pattern for the fabric of FIG. 1, in which the numbers across the top of the figure represent warp yarns 100 and 110, and the numbers down the left side of the figure represent the weft yarns. In this pattern, the BE weft yarns 220 are identified as 5, 9, 14, 18, 23, 27 and 32.

It can readily be seen from FIG. 1 that the BE yarns 220, while conforming to the weave pattern for the PS layer 2, and thus not affecting the required physical properties of the fabric in relation to aspects such as stability, are substantially larger in size than the regular sized PS weft yarns 200 and 210, thus forming a series of raised areas in the PS surface 4 which, in providing a contrasting profile to the areas of the PS surface 4 over the regular sized PS weft yarns 200 and 210, serve to enhance the bulk of the sheet (not shown) being carried by the fabric 1.

Figure 3:
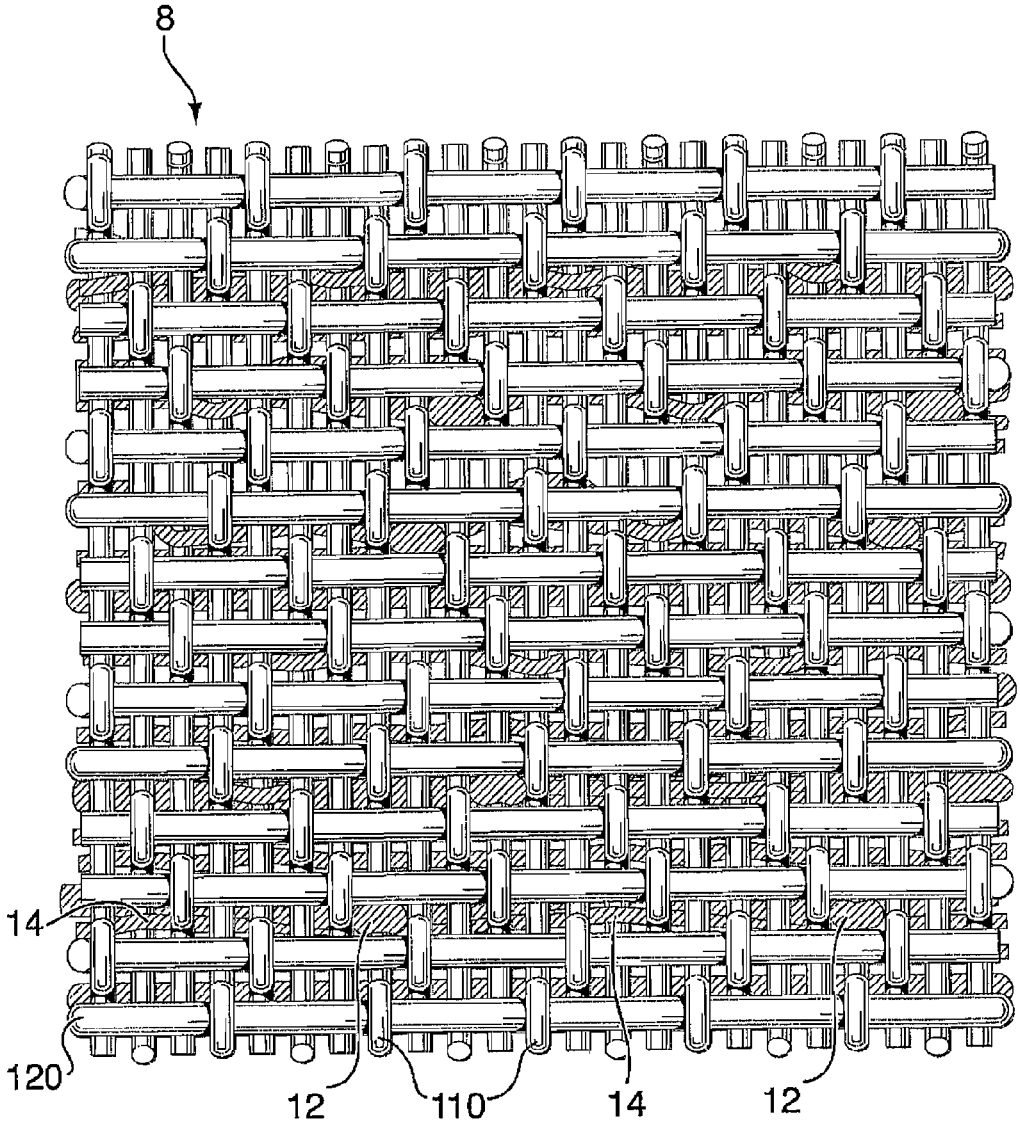
FIG. 3 shows the machine side of the embodiment of FIG. 1.

Referring now to FIG. 3, the MS surface 8 of the MS layer 6 is shown, in a repeating weave pattern in which the set of MS weft yarns 120 interlaces with the MS warp yarns 110. Additionally, the intrinsic binder weft yarns 210 also interlace with the MS warp yarns 110. As can readily be seen from this figure, the MS weft yarns 120 and MS warp yarns 110 are substantially equal in size, and are significantly larger than the regular sized intrinsic binder weft yarns 210. However, the BE weft yarns 220 are substantially equal in size to the MS weft yarns 120. As can also readily be seen, the smaller regular intrinsic binder weft yarns 210 are protected in the MS layer 6 by the larger MS weft yarns 120, for example at interlacing points 14, whereas the BE yarns 220, appearing in the MS layer 6 at interlacing locations 12, contribute to the strength of the fabric 1 and the abrasion resistance properties of the MS layer 6.

Figure 4:
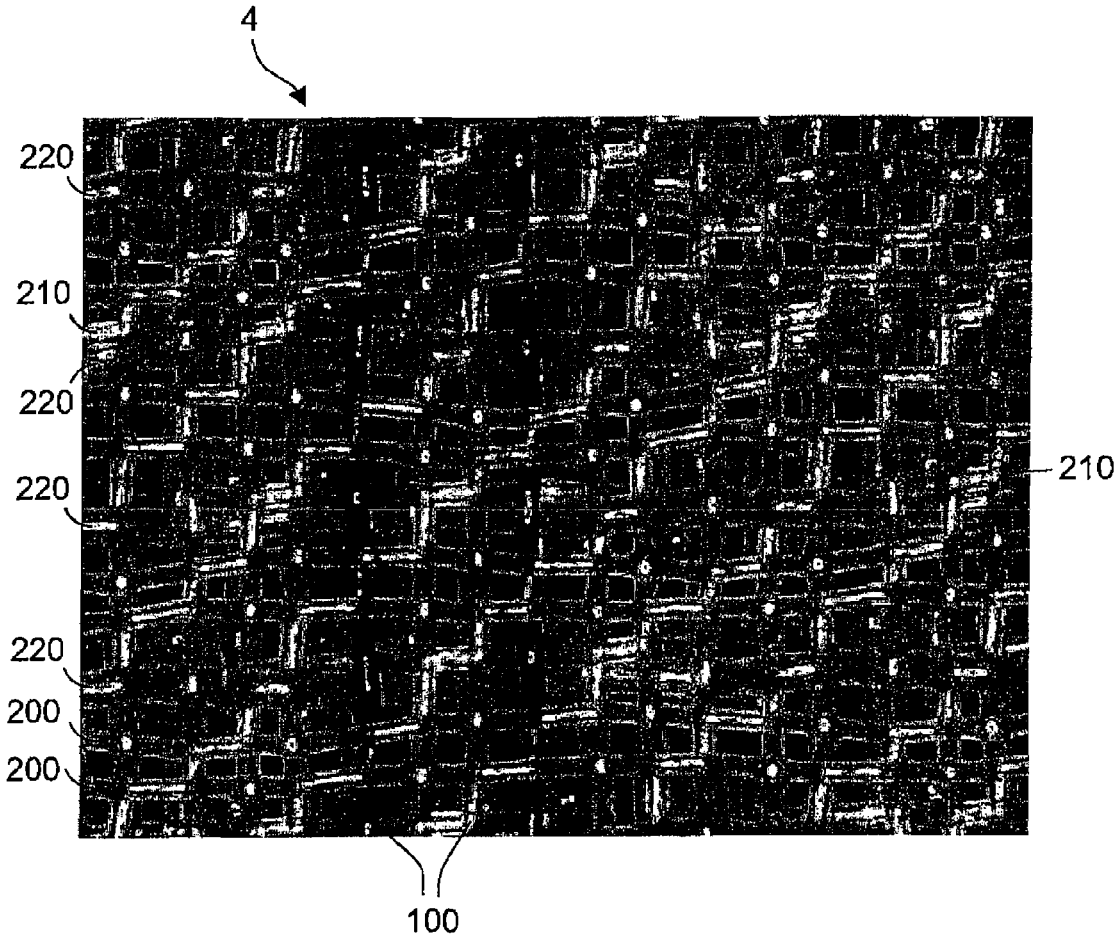
FIGS. 4 and 5 are photographs of the paper side of a second embodiment of the fabrics of the invention.
Figure 5:
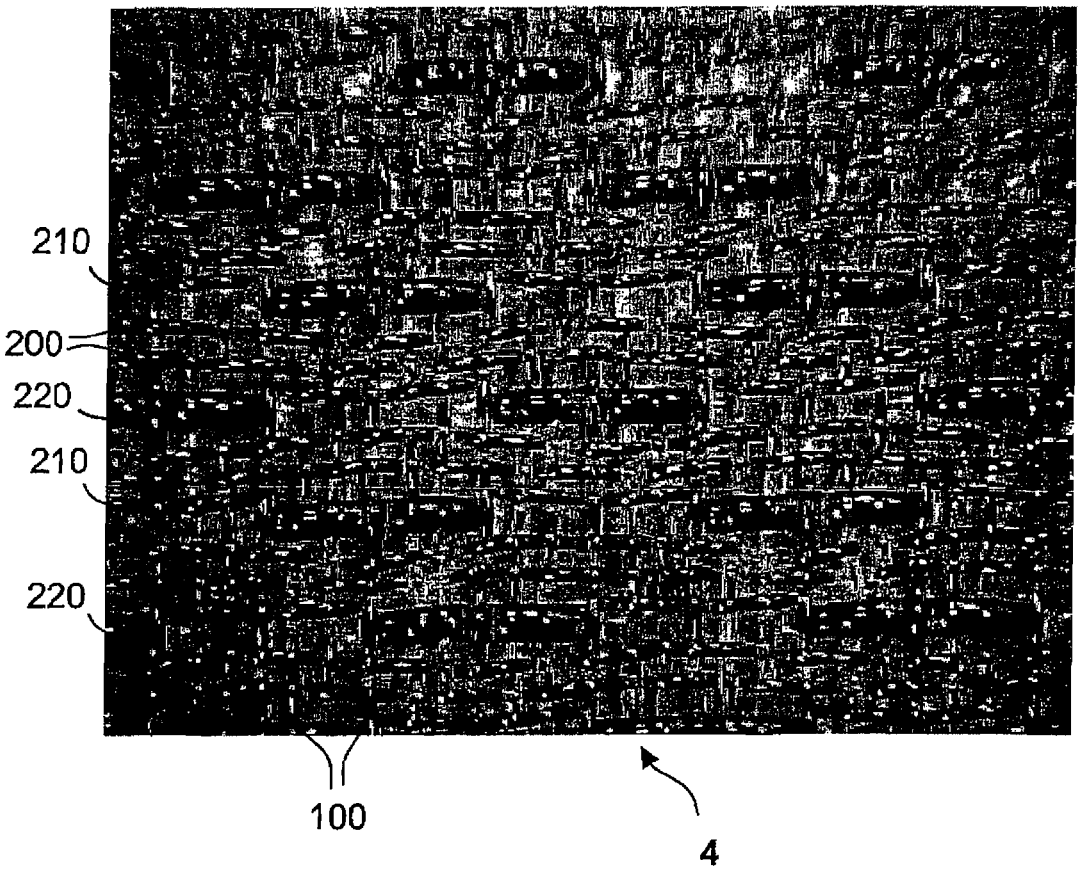

Referring now to FIGS. 4 and 5, a second embodiment of the invention is shown. In this fabric the larger BE weft yarn 220 (0.23 mm diameter) occurs as every fourth weft yarn in the PS layer 2, which causes it to occur in the same position in the pattern each repeat, here shown as being the first member of each pair of the intrinsic binder weft yarns 210. In this embodiment, the repeating weave pattern in the PS layer is a 2,1 twill, and the pattern repeats on every fourth weft. In this and similar embodiments, the BE yarn is always inserted into the same position in the weave pattern of the PS and does not cycle through other positions, as in the first embodiment shown in FIG. 1.

The fabric of FIG. 4 was woven using circular cross-section yarns, the regular PS weft yarns 200 and 210 having a diameter of 0.13 mm, and the BE weft yarns 220 having a diameter of 0.23 mm, the MS warp yarns 110 having a diameter of 0.23 mm, and the fabric having a mesh of 73×82 (number of warp and weft yarns respectively per inch) on the PS surface 4. However, this fabric has also been woven using a slightly larger BE weft yarn whose diameter is 0.28 mm, the MS warp yarns 110 having a diameter of 0.21 mm, and the fabric being woven to have a PS mesh of 73×78.

A third fabric was also woven according to the same construction as that shown in FIG. 4, using a BE weft yarn 220 diameter of 0.23 mm, but the regular PS weft yarns 200 and 210 had a diameter of 0.11 mm and the MS warp yarns 110 were reduced in size to 0.17 mm, for a PS mesh count of 90×85.

FIG. 7 is a weave diagram showing the complete repeating weave pattern for the fabric of FIG. 4, in which the numbers across the top of the figure represent warp yarns 100 and 110, and the numbers down the left side of the figure represent the weft yarns. In this pattern, the BE weft yarns 220 are identified as 2, 8, 14, 20, 26 and 32.

Referring now to FIG. 8, a weave diagram of a third embodiment of the invention is shown in which the numbers across the top of the figure represent warp yarns 100 and 110, and the numbers down the left side of the figure represent the weft yarns. In this pattern, the BE weft yarns 220 are identified as 5, 8, 13, 16, 21, 24, 29 and 32. As in the weave pattern shown in FIG. 6, in relation to the embodiment of FIG. 1, the BE yarns of the weave pattern shown in FIG. 8 cycle through each of the positions in the repeating weave pattern occupied by the primary weft yarns and the intrinsic binder weft yarns. However, in this weave pattern, when occupying the position of an intrinsic binder weft yarn, a BE yarn is not woven as one of a pair of such yarns, but replaces both members of the pair. For example, BE yarn 8 is woven so that in the PS layer 2 it will be immediately adjacent to PS primary weft yarn 6 and PS primary weft yarn 10, without a second regularly sized intrinsic binder weft yarn.

In each of FIGS. 1, 4 and 8, the repeating weave patterns provide for two primary PS weft yarns 200 between each pair of intrinsic weft binder yarns 210 (or single BE yarn occupying the position of a pair of intrinsic weft binder yarns 210, as in the weave pattern of FIG. 8). However, this is not necessary, and the number of primary PS weft yarns 200 between each pair of intrinsic weft binder yarn pairs 210 can be either constant (1, 2, 3 or more) or it can be irregular, varying between zero and up to at least 4. For example, a repeating weave pattern can be used similar to those described in U.S. Pat. No. 6,334,467 to Barrett et al. Where such irregular patterns are used, the BE weft yarns 220 can be located anywhere within the repeating weave pattern, without adversely affecting the inherent stability of the MS layer 6, in that such stability is provided by the weave pattern selected for the MS layer 6.

For the BE weft yarns 220 of these fabrics, a yarn which has a vertical dimension approximately twice that of the yarns normally used for the PS weft yarns 200 and 210 has been found to be particularly suitable, and significant improvements in the bulk of the paper product made using this fabric were achieved when compared to tissue made on a fabric in which these larger vertical dimension yarns had not been inserted; however, other sizes may provide beneficial results, depending on the specific intended end use for the fabric 1.

As noted above, the fabrics of the invention can also be constructed using a second set of BE weft yarns, i.e. where some of the BE weft yarns 220 are of one vertical dimension, substantially larger than that of the regular primary PS weft yarns 200 and intrinsic binder weft yarns 210, and the remainder of the BE weft yarns 220 are of a second, intermediate vertical dimension, being smaller than the first group of BE yarns, yet substantially larger than the regular PS weft yarns 200 and 210. These intermediate BE yarns can be inserted in the repeating weave patterns as shown in FIGS. 1 and 4, to replace one or more of the BE yarns shown therein.

Further, the fabrics of the invention can be selected from any of the types of multilayered fabric as described and defined above, according to the intended end use of the fabric. Preferably, they are either double layer or triple layer sheet support binder (also known as Intrinsic Weft, Paired Binder or Composite) constructions such as are disclosed by Seabrook et al. in U.S. Pat. No. 5,826,627 wherein the BE yarn is included in the weave pattern of the PS surface, its position is cycled from that of an intrinsic weft yarn to a regular weft yarn.

The fabrics of the invention, and the different layers thereof, can be woven to any repeating weave patterns which are known to be suitable for use for forming fabrics, and will be selected according to the intended end use. It is known to achieve a level of bulk enhancement by providing for one or more groups of yarns to have different float lengths from the remaining yarns in the PS surface. However, as noted above, for the fabrics of the invention, weave patterns providing for such variations of float length of some or all of the BE weft yarns in comparison with the regular sized PS weft yarns have been found to be particularly advantageous. For example, by way of illustration but not imposing any restriction on the selection of suitable weave patterns, the PS layer can be woven to a pattern selected from a plain weave, basket weave, twill or broken twill, and the MS layer can be woven to a pattern selected from a twill, broken twill, satin or and N×2N construction such as described by Barrett in U.S. Pat. No. 5,544,628. However, where the size ratio between the BE weft yarns 220 and the regular sized PS weft yarns 200 or 210 is at the maximum, the worker skilled in the art will appreciate that it would be more difficult to use a plain weave pattern for the PS layer 2.

Figure 10:
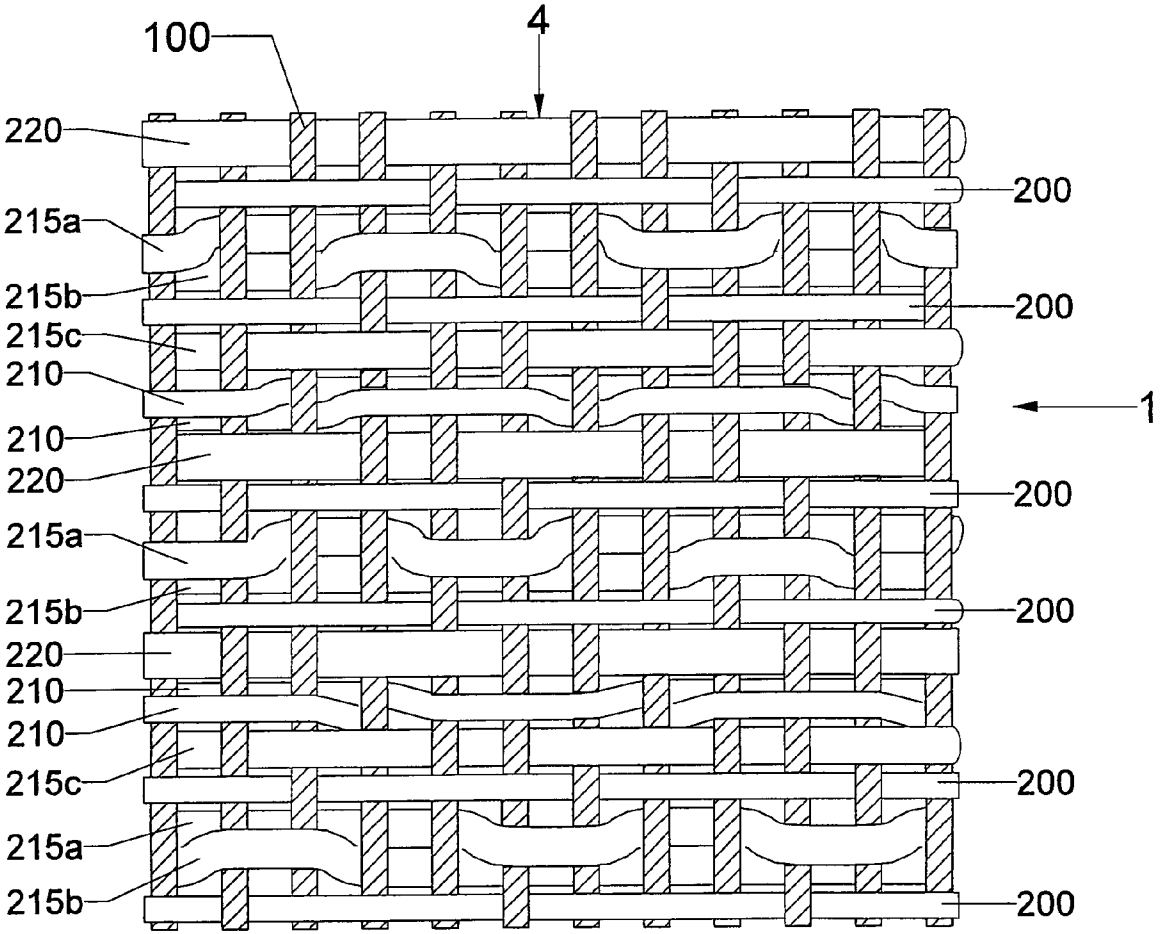
FIG. 10 shows the paper side of a fourth embodiment of the invention.

For example, FIG. 10 shows the PS surface 4 of a weave pattern for a fabric 1 in a fourth embodiment, in which the weft yarns float over either two or three PS warp yarns 100.

As can be seen, the weave pattern of this embodiment comprises two primary PS weft yarns 200 between each pair of intrinsic weft binder yarns 210. The fabric includes two sets of BE weft yarns, 215 and 220, the yarns of each set having different vertical dimensions. In this pattern, the first, and larger, BE weft yarns 220 only occupy the position of selected primary PS weft yarns 200, but the second BE weft yarns 215, which are smaller than the first BE weft yarns 220 but larger than the primary PS weft yarns 200, occupy the position of selected pairs of binder yarns and selected primary PS weft yarns. Thus, for example, the figure shows three pairs of BE weft yarns 215*a* and 215*b* in the position of binder yarn pairs, and two BE weft yarns 215*c* in the position of primary PS weft yarns.

In this embodiment, each of the first BE weft yarns 220 follows a weft path of over 2, under 2. Similarly, each of the second BE weft yarns 215, when occupying the position of a primary PS weft yarn, follows a weft path of over 2, under 2; and when a pair of second BE weft yarns 215 together occupies the position of a weft binder yarn pair, the single combined path in the PS is over 2, under 2. However, the regular weft yarns 200 follow weft paths of over 3, under 1.

It will be appreciated by those of skill in the art that other combinations of variation of float lengths with the use of the BE yarns will be suitable for the fabrics of the invention, depending on the intended end use of the fabric.

The BE weft yarns of the invention can be provided with a cross-section of any suitable configuration which is compatible with, but not necessarily the same as, that of the regular sized yarns of the fabric, and with the overall weave pattern, which in turn will take into account the intended end use of the fabric. Such configurations include, but are not limited to, any of circular, square, elliptical or rectangular, provided that the vertical dimension, measured in a direction substantially perpendicular to the PS surface 4 of the woven fabric 1, is at least 1.25 times the corresponding vertical dimension of the regular sized PS weft yarns 200 and 210.

Similarly, the BE weft yarns can be formed of any suitable material which is similarly compatible with that of the regular yarns of the fabric, which in turn is compatible with the intended end use. These would include, but not be limited to, polyethylene terephthalate (PET), nylons including those disclosed in U.S. Pat. No. 6,828,261 to Soelch et al., and polymer blends of stabilized polyurethane modified polyester such as disclosed in U.S. Pat. Nos. 5,502,120 and 5,169,711, each to Bhatt et al.

The invention claimed is:

1. A multilayered papermakers' forming fabric woven to a first repeating pattern, having a paper side layer with a paper side surface and a machine side layer having a machine side surface, and comprising (i) at least a first set of paper side layer warp yarns;

(ii) a second set of machine side layer warp yarns;

(iii) at least a first set of cross-machine direction (CD) machine side layer weft yarns; and (iv) paper side layer weft yarns woven in a second repeating pattern with at least some of the paper side layer warp yarns, and comprising (a) primary weft yarns which do not contribute to the machine side surface; and (b) pairs of intrinsic weft binder yarns;

wherein (1) at least some of the paper side layer weft yarns comprise an array of bulk enhancing weft yarns each having a vertical dimension measured in a direction substantially perpendicular to the paper side surface of the fabric which exceeds a corresponding vertical dimension of each of the remaining paper side layer weft yarns in a ratio of at least 1.5:1; and (2) the array of bulk enhancing weft yarns is selected from at least one of the group comprising primary weft yarns, intrinsic weft binder yarns, and a combination of primary weft yarns and intrinsic weft binder yarns.

2. A multilayered papermakers' forming fabric as claimed in claim 1, wherein in the second repeating weave pattern, weft paths of at least some of the bulk enhancing weft yarns include paper side floats having different lengths from paper side float lengths of the remaining paper side layer weft yarns.

3. A multilayered papermakers' forming fabric as claimed in claim 2, wherein at least some of the array of bulk enhancing weft yarns have a float length in the paper side layer of between two and eleven warp yarns.

4. A multilayered papermakers' forming fabric as claimed in claim 1, wherein in each repeat of the second repeating weave pattern the number of primary weft yarns between consecutive pairs of intrinsic weft binder yarns is regular.

5. A multilayered papermakers' forming fabric as claimed in claim 1, wherein in each repeat of the second repeating weave pattern, the number of primary weft yarns provided between consecutive pairs of intrinsic binder weft yarns is irregular, and members of the array of bulk enhancing weft yarns occupy weft paths allocated to selected ones of the primary weft yarns, and first and second members of the pairs of intrinsic binder weft yarns.

6. A multilayered papermakers' forming fabric as claimed in claim 4, wherein in each repeat of the second repeating weave pattern consecutive members of the array of bulk enhancing weft yarns occupy in sequence weft paths allocated to each primary weft yarn and each member of a pair of intrinsic binder weft yarns.

7. A multilayered papermakers' forming fabric as claimed in claim 6, wherein in each repeat of the second repeating weave pattern consecutive members of the array of bulk enhancing weft yarns occupy in sequence weft paths allocated to each primary weft yarn and a weft path between selected groups of primary weft yarns.

8. A multilayer papermakers' forming fabric as claimed in claim 1, wherein in each repeat of the second repeating weave pattern, at least one primary weft yarn is provided between each pair of intrinsic binder weft yarns, and the array of bulk enhancing weft yarns is selected only from one of the group comprising primary weft yarns, first members of the pairs of intrinsic binder weft yarns, and second members of the pairs of intrinsic weft binder yarns.

9. A multilayered papermakers' forming fabric as claimed in claim 1, wherein the array of bulk enhancing weft yarns comprises at least a first and second set, wherein the vertical dimension of each weft yarn of the second set is less than the corresponding vertical dimension of each of the weft yarns of the first set.

10. A multilayered papermakers' forming fabric as claimed in claim 1, wherein the vertical dimension of the array of bulk enhancing weft yarns exceeds the corresponding vertical dimension of the remaining paper side layer weft yarns in a ratio of at least 2:1.

11. A multilayered papermakers' forming fabric as claimed in claim 9, wherein the vertical dimension of at least the first set of the array of bulk enhancing weft yarns exceeds the corresponding vertical dimension of the remaining paper side layer weft yarns in a ratio of at least 2:1.

12. A multilayered papermakers' forming fabric as claimed in claim 1, wherein the array of bulk enhancing weft yarns comprises between 10% and 50% of the paper side layer weft yarns.

13. A multilayered papermakers' forming fabric as claimed in claim 1, wherein the second repeating weave pattern is selected from plain weave, twill, broken twill, satin and basket weave, and the machine side layer is woven to a third repeating weave pattern selected from twill, broken twill, satin and an N×2N pattern in which N quantifies the warp yarns in one repeat of the third repeating weave pattern and 2N quantifies the weft yarns in one repeat of the third repeating weave pattern, and N is an integer greater than 2.

14. A multilayered papermakers' forming fabric as claimed in claim 13, wherein N is 6.

15. A multilayered papermakers' forming fabric as claimed in claim 1, wherein at least some of the array of bulk enhancing weft yarns have a float length in the paper side layer of between two and eleven warp yarns.

16. A multilayered papermakers' forming fabric as claimed in claim 1, wherein each member of the array of bulk enhancing weft yarns has a cross-sectional configuration selected from circular, square, elliptical and rectangular.

17. A multilayered papermakers' forming fabric woven to a first repeating pattern, having a paper side layer with a paper side surface and a machine side layer having a machine side surface, and comprising (i) machine direction (MD) warp yarns;

(ii) at least a first set of cross-machine direction (CD) machine side layer weft yarns; and (iii) paper side layer weft yarns woven in a second repeating pattern with at least some of the MD warp yarns;

wherein (a) at least some of the paper side layer weft yarns comprise an array of bulk enhancing weft yarns each having a vertical dimension measured in a direction substantially perpendicular to the paper side surface of the fabric which exceeds a corresponding vertical dimension of each of the remaining paper side layer weft yarns in a ratio of at least 1.5:1;

(b) the warp yarns comprise only pairs of warp binder yarns interwoven with the paper side layer weft yarns and machine side layer weft yarns;

(c) in the paper side surface, each pair of warp binder yarns occupies a single combined path and is woven in the overall repeating weave pattern such that for each pair;

(A) in a first segment of the single combined path, a first member of the pair interweaves with selected paper side layer weft yarns at an interweaving location, and a second member of the pair interlaces with at least one machine side layer weft yarn at an interlacing location;

(B) in a second segment of the single combined path, the second member of the pair interweaves with selected paper side layer weft yarns at an interweaving location, and the first member of the pair interlaces with at least one machine side layer weft yarn;

(C) the length of the first and second segments may be equal or unequal;

(D) between each adjacent segment the members exchange positions at an exchange point, and the members are laterally displaced in relation to each other along the single combined path at and between each consecutive exchange point.

18. A multilayered papermakers' forming fabric as claimed in claim 17, wherein in the second repeating weave pattern, weft paths of at least some of the bulk enhancing weft yarns include paper side floats having different lengths from paper side float lengths of the remaining paper side layer weft yarns.

19. A multilayered papermakers' forming fabric woven to a first repeating pattern, having a paper side layer with a paper side surface and a machine side layer having a machine side surface, and comprising (i) machine direction (MD) warp yarns;

(ii) at least a first set of cross-machine direction (CD) machine side layer weft yarns; and (iii) paper side layer weft yarns woven in a second repeating pattern with at least some of the MD warp yarns;

wherein (a) at least some of the paper side layer weft yarns comprise an array of bulk enhancing weft yarns each having a vertical dimension measured in a direction substantially perpendicular to the paper side surface of the fabric which exceeds a corresponding vertical dimension of each of the remaining paper side layer weft yarns in a ratio of at least 1.5:1;

(b) the warp yarns comprise a set of triplet warp yarns which are interwoven with the paper side layer weft yarns and the machine side layer weft yarns in a repeating pattern, wherein (A) each member of each triplet of warp yarns interweaves with the paper side layer weft yarns to occupy in sequence segments of a single combined warp path in the paper side layer;

(B) the sequence of segments repeats as part of the repeating pattern;

(C) each segment in the unbroken warp path is separated from the next segment by at least one paper side layer weft yarn;

(D) each member of each triplet interlaces separately with a single machine side layer weft yarn at least once within the pattern repeat;

(E) within the first repeating pattern the number of machine side layer weft yarns between each interlacing point of successive yarns from each triplet of warp yarns is constant; and (F) within the first repeating pattern the path length of each member of each triplet is the same.

20. A multilayered papermakers' forming fabric as claimed in claim 19, wherein in the second repeating weave pattern, weft paths of at least some of the bulk enhancing weft yarns include paper side floats having different lengths from paper side float lengths of the remaining paper side layer weft yarns.

* * * * *